US005632341A

United States Patent [19]

Allen

[11] Patent Number: 5,632,341

[45] Date of Patent: May 27, 1997

[54] CEILING MOUNTED ROTATING FIRE EXTINGUISHING SYSTEM

[76] Inventor: Derek L. Allen, 1103 Franklin Ave., Apt. #10, Bronx, N.Y. 10456

[21] Appl. No.: 562,702

[22] Filed: Nov. 27, 1995

[51] Int. Cl.[6] ..... A62C 35/20

[52] U.S. Cl. ..... 169/52; 169/26; 169/37

[58] Field of Search ..... 169/5, 9, 26, 37, 169/51, 52

[56] References Cited

U.S. PATENT DOCUMENTS

| | | | |
|---|---|---|---|
| 1,038,850 | 9/1912 | Charbonneau et al. | 169/26 |
| 4,351,393 | 9/1982 | Tyree | 169/37 |
| 5,441,113 | 8/1995 | Pierce | 169/5 |

*Primary Examiner*—Gary C. Hoge

[57] ABSTRACT

A ceiling mounted rotating fire extinguishing system comprised of a cylindrical housing having four heat sensitive sprinkler heads positioned therearound. A fire retardant liquid container is secured within the cylindrical housing. The liquid container has a five way piping system extending outwardly of a lower portion thereof. The five way piping system has four extensions coupled with the four heat sensitive sprinkler heads in the cylindrical housing. The five way piping system has a downwardly extending pipe extending outwardly of the cylindrical housing. A spraying housing has a plurality of heat sensitive sprinkler heads extending outwardly thereof. The spraying housing is adapted for rotatable coupling with the downwardly extending pipe of the fire retardant liquid container. A motor is secured within the cylindrical housing. The motor rotating the spraying housing with respect to the cylindrical housing.

5 Claims, 3 Drawing Sheets

CEILING MOUNTED ROTATING FIRE EXTINGUISHING SYSTEM

BACKGROUND OF THE INVENTION

1. Field of the Invention

The present invention relates to a ceiling mounted rotating fire extinguishing system and more particularly pertains to spraying a fire retardant liquid throughout a room to extinguish a fire with a ceiling mounted rotating fire extinguishing system.

2. Description of the Prior Art

The use of fire sprinkling systems is known in the prior art. More specifically, fire sprinkling systems heretofore devised and utilized for the purpose of extinguishing fires are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,893,679 to Martine et al. discloses a heat-responsive element for fire protection sprinklers or the like.

U.S. Pat. No. 4,741,361 to McHugh discloses a valve and arrangement for fire suppression water sprinkler system.

U.S. Pat. No. 4,091,876 to Valdatta discloses a fire sprinkling system for mobile trailers.

U.S. Pat. No. 3,876,008 to Scruggs discloses a fire extinguishing sprinkling system.

U.S. Pat. No. 3,651,869 to Livingston et al. discloses a fire-responsive sprinkler head.

U.S. Pat. No. 3,473,612 to Poitras discloses a fire extinguishing sprinkler system.

While these devices fulfill their respective, particular objective and requirements, the aforementioned patents do not describe a ceiling mounted rotating fire extinguishing system for spraying a fire retardant liquid throughout a room to extinguish a fire.

In this respect, the ceiling mounted rotating fire extinguishing system according to the present invention substantially departs from the conventional concepts and designs of the prior art, and in doing so provides an apparatus primarily developed for the purpose of spraying a fire retardant liquid throughout a room to extinguish a fire.

Therefore, it can be appreciated that there exists a continuing need for new and improved ceiling mounted rotating fire extinguishing system which can be used for spraying a fire retardant liquid throughout a room to extinguish a fire. In this regard, the present invention substantially fulfills this need.

SUMMARY OF THE INVENTION

In the view of the foregoing disadvantages inherent in the known types of fire sprinkling systems now present in the prior art, the present invention provides an improved ceiling mounted rotating fire extinguishing system. As such, the general purpose of the present invention, which will be described subsequently in greater detail, is to provide a new and improved ceiling mounted rotating fire extinguishing system and method which has all the advantages of the prior art and none of the disadvantages.

To attain this, the present invention essentially comprises a cylindrical housing having a planar upper surface, a planar lower surface, and a surrounding side wall therebetween. The cylindrical housing has a hollow interior. The surrounding side wall has four heat sensitive sprinkler heads positioned therearound. A fire retardant liquid container is secured within the hollow interior of the cylindrical housing. The liquid container has a five way piping system extending outwardly of a lower portion thereof. The five way piping system has four extensions coupled with the four heat sensitive sprinkler heads in the surrounding side wall of the cylindrical housing. The five way piping system has a downwardly extending pipe extending outwardly of the planar lower surface of the cylindrical housing. The downwardly extending pipe has a flange integral with an end portion thereof. The flange has a bushing coupled to an upper surface thereof. The device contains a spraying housing having a planar upper surface and a planar lower surface. The planar lower surface has a plurality of heat sensitive sprinkler heads extending outwardly thereof. The planar upper surface is adapted for rotatable coupling over the flange of the downwardly extending pipe of the fire retardant liquid container. A motor is secured within the hollow interior of the cylindrical housing. The motor has means to rotate the spraying housing with respect to the cylindrical housing. The motor has wiring extending outwardly of the upper planar surface of the cylindrical housing. An activation switch is secured to a wall adjacent to the system. The activation switch is electrically coupled with the wire of the motor. The activation switch is electrically coupled to an electrical source.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ceiling mounted rotating fire extinguishing system which has all the advantages of the prior art fire sprinkling systems and none of the disadvantages.

It is another object of the present invention to provide a new and improved ceiling mounted rotating fire extinguishing system which may be easily and efficiently manufactured and marketed.

It is a further object of the present invention to provide a new and improved ceiling mounted rotating fire extinguishing system which is of durable and reliable construction.

An even further object of the present invention is to provide a new and improved ceiling mounted rotating fire extinguishing system which is susceptible of a low cost of manufacture with regard to both materials and labor, and which accordingly is then susceptible of low prices of sale to the consuming public, thereby making such a ceiling mounted rotating fire extinguishing system economically available to the buying public.

Still yet another object of the present invention is to provide a new and improved ceiling mounted rotating fire extinguishing system which provides in the apparatuses and methods of the prior art some of the advantages thereof, while simultaneously overcoming some of the disadvantages normally associated therewith.

Even still another object of the present invention is to provide a new and improved ceiling mounted rotating fire extinguishing system for spraying a fire retardant liquid throughout a room to extinguish a fire.

Lastly, it is an object of the present invention to provide a new and improved ceiling mounted rotating fire extinguishing system comprised of a cylindrical housing having four heat sensitive sprinkler heads positioned therearound. A fire retardant liquid container is secured within the cylindrical housing. The liquid container has a five way piping system extending outwardly of a lower portion thereof. The five way piping system has four extensions coupled with the four heat sensitive sprinkler heads in the cylindrical housing. The five way piping system has a downwardly extending pipe extending outwardly of the cylindrical housing. A spraying housing has a plurality of heat sensitive sprinkler heads extending outwardly thereof. The spraying housing is adapted for rotatable coupling with the downwardly extending pipe of the fire retardant liquid container. A motor is secured within the cylindrical housing. The motor rotating the spraying housing with respect to the cylindrical housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
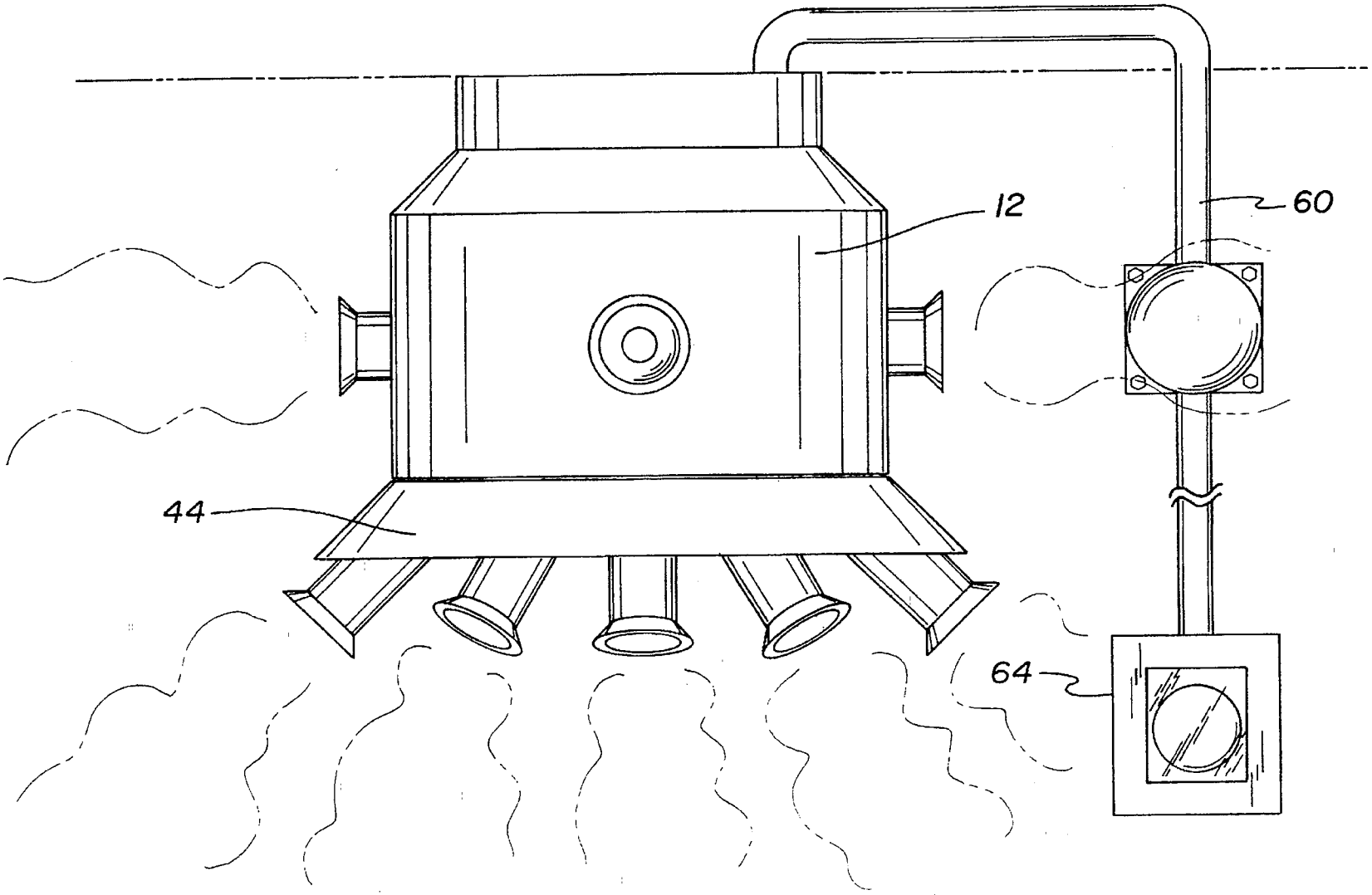
FIG. 1 is a front view of the preferred embodiment of the ceiling mounted rotating fire extinguishing system constructed in accordance with the principles of the present invention.
Figure 2:
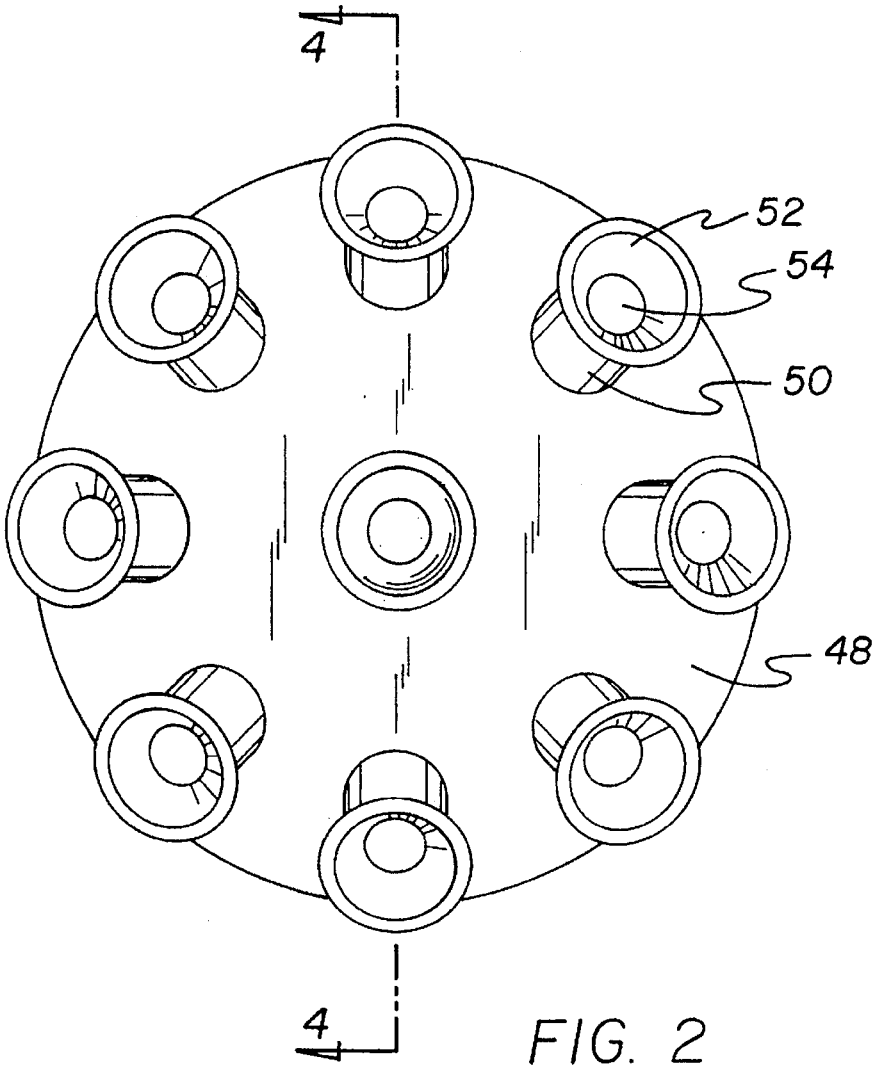
FIG. 2 is a bottom view of the present invention illustrating the sprinkler head arrangement.
Figure 3:
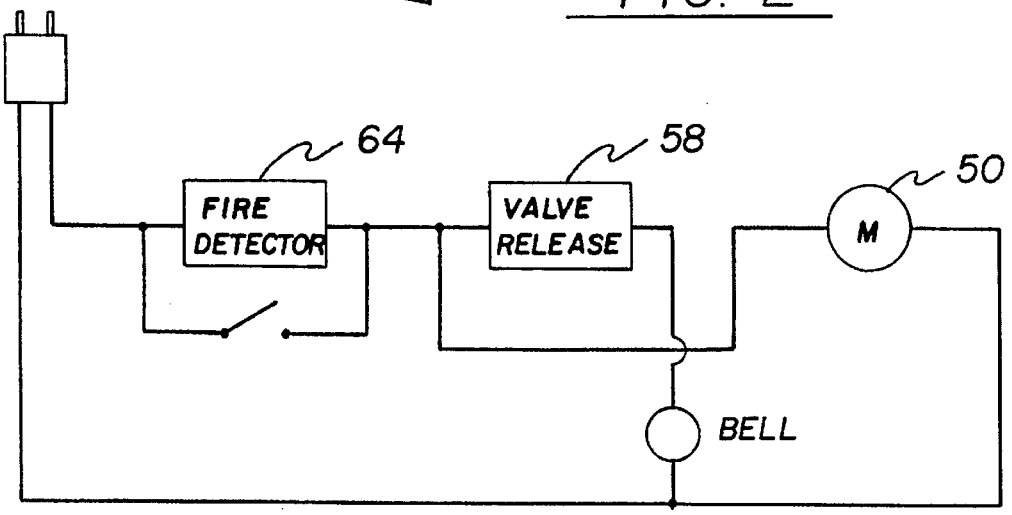
FIG. 3 is a schematical illustration of the present invention.
Figure 4:
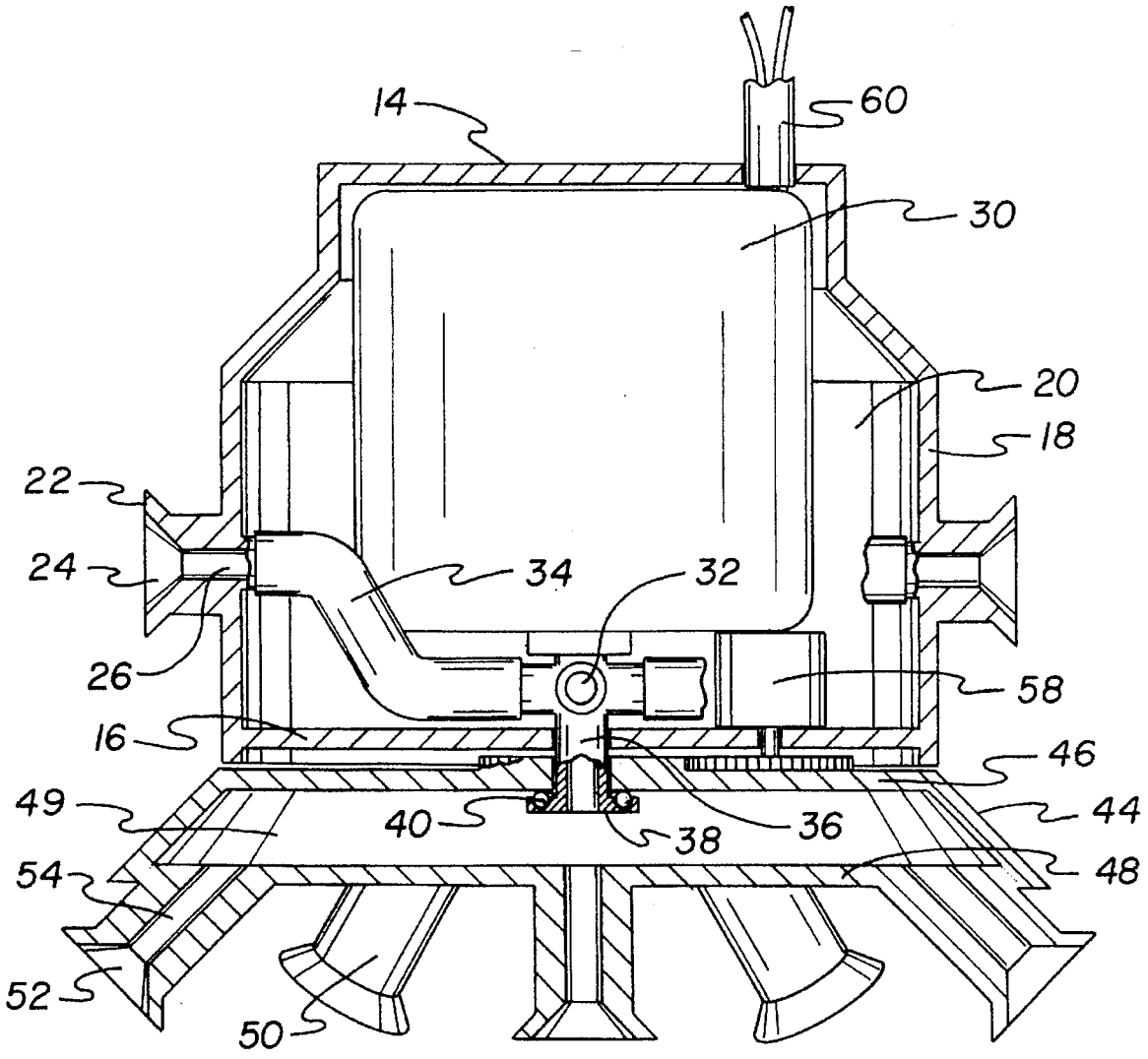
FIG. 4 is a cross-sectional view as taken along line 4—4 of FIG. 2.

With reference now to the drawings, and in particular, to FIGS. 1–4 thereof, the preferred embodiment of the new and improved ceiling mounted rotating fire extinguishing system embodying the principles and concepts of the present invention and generally designated by the reference number 10 will be described.

Specifically, it will be noted in the various Figures that the device relates to a new and improved ceiling mounted rotating fire extinguishing system for spraying a fire retardant liquid throughout a room to extinguish a fire. In its broadest context, the device consists of a cylindrical housing, a fire retardant liquid container, a spraying housing, a motor, and an activation switch. Such components are individually configured and correlated with respect to each other so as to attain the desired objective.

The device 10 includes a cylindrical housing 12 having a planar upper surface 14, a planar lower surface 16, and a surrounding side wall 18 therebetween. The planar upper surface 14 having a diameter less than that of the planar lower surface 16. The cylindrical housing 12 has a hollow interior 20. The surrounding side wall 18 has four heat sensitive sprinkler heads 22 positioned therearound. The four heat sensitive sprinkler heads 22 are positioned equally distanced from each other around the cylindrical housing 12 at ninety degree intervals. The four heat sensitive sprinkler heads 22 each have a conical opening 24 extending outwardly of the surrounding side wall 18 and a tubular portion 26 extending within the hollow interior 20. The planar upper surface 14 is securable to a ceiling in a room. The heat sensitive sprinkler heads 22 sense smoke within the room and will activate upon such a sensing.

A fire retardant liquid container 30 is secured within the hollow interior 20 of the cylindrical housing 12. The fire retardant liquid container 30 holds a supply of a fire extinguishing solution, such as water, carbon dioxide, a mixture of both, or the like. The liquid container 30 has a five way piping system 32 extending outwardly of a lower portion thereof. The five way piping system 32 has four extensions 34 coupled with the four heat sensitive sprinkler heads 22 in the surrounding side wall 18 of the cylindrical housing 12. The four extensions 34 are each coupled with the tubular portions 26 of the four heat sensitive sprinkler heads 22 to deliver the fire retardant liquid therethrough to be sprayed outwardly of the conical openings 24 to extinguish a fire. The five way piping system 32 has a downwardly extending pipe 36 extending outwardly of the planar lower surface 16 of the cylindrical housing 12. The downwardly extending pipe 36 has a flange 38 integral with an end portion thereof. The flange 38 has a bushing 40 coupled to an upper surface thereof. Alternately, the fire retardant liquid container 30 could be replaced by a direct water line extending into the cylindrical housing 12 to couple with the five way piping system 32.

The device 10 contains a spraying housing 44 having a planar upper surface 46 and a planar lower surface 48. Between the planar upper surface 46 and the planar lower surface 48 is a hollow interior 49. The planar lower surface 46 has a plurality of heat sensitive sprinkler heads 50 extending outwardly thereof. The planar upper surface 46 is adapted for rotatable coupling over the flange 38 of the downwardly extending pipe 36 of the fire retardant liquid container 30. The bushing 40 serves to facilitate the rotation of the spraying housing 44 with respect to the cylindrical housing 12. The downwardly extending pipe 36 delivers fire retardant liquid into the hollow interior 49. The plurality of heat sensitive sprinkler heads 50 each has a conical opening 52 extending outwardly of the planar lower surface 48 and a tubular portion 54 extending within the hollow interior 49 to transport the fire retardant liquid to be sprayed out of the conical opening 52 to extinguish a fire.

A motor 58 is secured within the hollow interior 20 of the cylindrical housing 12. The motor 50 has means to rotate the spraying housing 44 with respect to the cylindrical housing 12. The motor 58 has wiring 60 extending outwardly of the upper planar surface 14 of the cylindrical housing 12.

An activation switch 64 is secured to a wall adjacent to the system. The activation switch 64 is electrically coupled with the wire 60 of the motor 58. The activation switch 64 is electrically coupled to an electrical source. The activation switch 64 is a back-up system to the heat sensitive sprinkler heads to activate the spraying of the fire retardant liquid outwardly therefrom. In electrical parallel with the motor 58 for activating the valve release and the fire detector is a bell. Note FIG. 3. Such bell functions to provide an audio alarm to people endangered by the fire when the fire is detected for further safety.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A ceiling mounted rotating fire extinguishing system for spraying a fire retardant liquid throughout a room to extinguish a fire comprising, in combination:

a cylindrical housing having a planar upper surface, a planar lower surface, and a surrounding side wall therebetween, the cylindrical housing having a hollow interior, the surrounding side wall having four heat sensitive sprinkler heads positioned therearound;

a fire retardant liquid container secured within the hollow interior of the cylindrical housing, the liquid container having a five way piping system extending outwardly of a lower portion thereof, the five way piping system having four extensions coupled with the four heat sensitive sprinkler heads in the surrounding side wall of the cylindrical housing, the five way piping system having a downwardly extending pipe extending outwardly of the planar lower surface of the cylindrical housing, the downwardly extending pipe having a flange integral with an end portion thereof, the flange having a bushing coupled to an upper surface thereof;

a spraying housing having a planar upper surface and a planar lower surface, the planar lower surface having a plurality of heat sensitive sprinkler heads extending outwardly thereof, the planar upper surface adapted for rotatable coupling over the flange of the downwardly extending pipe of the fire retardant liquid container;

a motor secured within the hollow interior of the cylindrical housing, the motor having means to rotate the spraying housing with respect to the cylindrical housing, the motor having wiring extending outwardly of the upper planar surface of the cylindrical housing;

an activation switch secured to a wall adjacent to the system, the activation switch being electrically coupled with the wire of the motor, the activation switch being electrically coupled to an electrical source.

2. A ceiling mounted rotating fire extinguishing system comprising:

a cylindrical housing having four heat sensitive sprinkler heads positioned therearound;

a fire retardant liquid container secured within the cylindrical housing, the liquid container having a five way piping system extending outwardly of a lower portion thereof, the five way piping system having four extensions coupled with the four heat sensitive sprinkler heads in the cylindrical housing, the five way piping system having a downwardly extending pipe extending outwardly of the cylindrical housing;

a spraying housing having a plurality of heat sensitive sprinkler heads extending outwardly thereof, the spraying housing adapted for rotatable coupling with downwardly extending pipe of the fire retardant liquid container;

a motor secured within the cylindrical housing, the motor rotating the spraying housing with respect to the cylindrical housing.

3. The system as set forth in claim 2 and further including an activation switch secured to a wall adjacent to the system, the activation switch being electrically coupled with the motor, the activation switch being electrically coupled to an electrical source.

4. The system as set forth in claim 2 wherein the downwardly extending pipe having a flange integral with an end portion thereof, the flange having a bushing coupled to an upper surface thereof, the flange being rotatably coupled with the spraying housing.

5. The system as set forth in claim 2 and further including an audio alarm adapted to be activated when fire is detected.

* * * * *